US007226237B2

(12) United States Patent
Ceccarelli

(10) Patent No.: US 7,226,237 B2
(45) Date of Patent: Jun. 5, 2007

(54) ROAD BARRIER

(76) Inventor: Gildo Ceccarelli, Via Sant'Elisabetta, 11, Perugia (IT) 06123

( * ) Notice: Subject to any disclaimer, the term of this patent is extended or adjusted under 35 U.S.C. 154(b) by 198 days.

(21) Appl. No.: 10/528,462

(22) PCT Filed: Sep. 17, 2003

(86) PCT No.: PCT/IB03/03996

§ 371 (c)(1),
(2), (4) Date: Mar. 21, 2005

(87) PCT Pub. No.: WO2004/027159

PCT Pub. Date: Apr. 1, 2004

(65) Prior Publication Data

US 2005/0254891 A1 Nov. 17, 2005

(30) Foreign Application Priority Data

Sep. 23, 2002 (IT) ..... UD2002A0197

(51) Int. Cl.
*E01F 13/00* (2006.01)
*E04H 17/14* (2006.01)

(52) U.S. Cl. ..... 404/6; 256/13.1

(58) Field of Classification Search ..... 404/6, 404/9, 10; 256/1, 13.1
See application file for complete search history.

(56) References Cited

FOREIGN PATENT DOCUMENTS

DE 20113347 10/2001

*Primary Examiner*—Raymond Addie
(74) *Attorney, Agent, or Firm*—Stevens, Davis, Miller & Mosher, LLP

(57) ABSTRACT

Road barrier comprising a plurality of modules consisting at least of an upright, or vertical component, fixed in the ground, and a first longitudinal element, or horizontal component, made with tubular profiles. The upright is arranged through inside the first longitudinal element, so that the latter can be moved vertically and selectively clamped at a desired height.

30 Claims, 4 Drawing Sheets

ROAD BARRIER

This application is a §371 National Stage Application of International Application No. PCT/IB2003/003996, filed on 17 Sept. 2003, claiming the priority of Italian Patent Application No. UD2002A000197 filed on 23 Sep. 2002.

FIELD OF THE INVENTION

The present invention concerns a road safety barrier that can be used both as a traffic-divider and also as a lateral protection element, in order to prevent, or at least reduce, the risk that vehicles passing on the roadway where it is installed might come off the road or leap-frog the barrier.

BACKGROUND OF THE INVENTION

Two types of road barriers are known, which differ from each other essentially in the structure and construction material. A first type of barrier, also called "guard-rail", is made of metal and comprises a plurality of vertical uprights, separated from each other with a constant pitch, made with open section profiles, for example U-shaped or similar, fixed into the ground, onto which longitudinal elements or longitudinal profiles, also with an open section and made of undulated sheet, are attached.

The second type of barrier, called "New Jersey", consists of a plurality of modules, consisting of concrete or metal blocks, which are coupled with each other laterally and anchored to the roadway.

The advantages of the guard-rail barriers are essentially due to the greater structural elasticity that, in the event of an accident, allows high shock absorption and an adequate deformation of the barrier, generally limiting the consequences for the people involved. However, in the event of a violent impact, this type of barrier does not guarantee an adequate containment, so that the vehicle can knock down the barrier and go off the road, or leap-frog the barrier and finish up on the opposite carriageway. Moreover, the open profile sheet that forms the longitudinal elements constitutes a cutting element, which can turn out to be very dangerous for the people involved in the accident.

The "New Jersey" barrier has a greater resistance to shock, and therefore it is more difficult to knock down; moreover, it defines an inclined surface at the base, converging towards the roadway which, if mounted by the tires of a vehicle, encourages the latter to return inside the carriageway, preventing it from knocking into the barrier and from leap-frogging it. This inclined surface is, however, very short and very near the vertical part of the barrier so that, even if it can prevent the collision, it cannot prevent the parts of the vehicle protruding from the sides, for example the side mirrors, from scraping the barrier.

The rigidity of the "New Jersey" barrier, moreover, especially if it is made of concrete, in the case of a collision generally causes more damage both to vehicles and also, consequently, to the people involved.

Furthermore, when it is made of metal, the "New Jersey" barrier has problems of transport and of construction, because it is difficult to make a large size box-like structure.

A further limitation common to these two types of road barrier is when, for example due to successive applications of asphalt, or the installation of soundproofing panels, it is necessary to increase the height of the barrier with respect to the roadway. This operation, in fact, can be carried out only by replacing particular components, or by complex operations of joining or anchoring new elements to the existing barrier, with considerable expense and long execution times.

Another shortcoming of conventional barriers concerns the maintenance operations that have to be periodically carried out to restore the barrier after even only small collisions. Moreover, especially in the case of guard-rail barriers, there is the problem of the growth of grass between one upright and the other, which makes frequent grass-cutting operations necessary; such operations are difficult due to the presence of the uprights, which make it difficult to cut round them, and also because the zones located under the longitudinal elements can only be reached with difficulty with conventional cutting instruments.

The difficulties connected to the operations to modify and maintain conventional road barriers, and the frequency thereof, entail not only a waste of economic and human resources, but also considerable and prolonged problems to the traffic in those sections of road where they have to be carried out.

Document DE-U-201 13 347 discloses a road barrier according to the preamble of independent claim 1.

The present Applicant has devised and embodied this invention to overcome the shortcomings of the state of the art, and to obtain further advantages.

SUMMARY OF THE INVENTION

The present invention is set forth and characterized in the main claim, while the dependent claims describe other characteristics of the invention.

The purpose of the invention is to achieve a road barrier that guarantees both high elasticity and capacity to absorb the shock, and also a certain resistance to breakthrough, so as to limit damage to the vehicle and persons in the event of an impact, and at the same time reduce the risk that the vehicle might go off the road or leap-frog the barrier.

Another purpose of the invention is to achieve a road barrier without metal profiles with an open section, so as to limit the risks for the people involved in accidents. Another purpose is to achieve a road barrier that allows to perform easy and quick modification and/or maintenance operations.

A further purpose is to prevent collisions and scraping of the vehicles against the barrier, at least in the case of skids and superficial accidents.

In accordance with such purposes, the road barrier according to the invention comprises a plurality of modules that can be coupled together in succession, each of which has at least an upright, a first longitudinal element and a base consisting of tubular metal profiles. According to a variant, the base consists of a full section article, for example made of armed or reinforced concrete.

The upright is fixed into the ground and is located through both inside the first longitudinal element and also inside the base, so that at least the first longitudinal element can be moved vertically and clamped at the desired height along the upright.

In a preferential form of embodiment, the clamping is reversible and is obtained with pin means cooperating with collar means integrally made on the first longitudinal element, or associated therewith.

According to a variant, the first longitudinal element is clamped vertically between collar means arranged above and below said element and attached only to the upright.

According to a characteristic of the invention, the upright is off-center towards the outside of the carriageway with respect to the base, which has at least an inclined side facing towards the roadway. In a preferential embodiment, the inclined side has a curvilinear conformation and defines a concave portion facing towards the roadway. In this way, in the event that a vehicle gets very close to the barrier, its tires come into contact only with the base, whose inclined side will tend to return the vehicle towards the roadway, while the upright and the longitudinal element will not be hit and hence will not suffer any damage.

The base is mounted on spacer elements that keep it slightly raised with respect to the ground, and separated from each other, so as to allow the water to drain from the roadway. The proximity of the base to the ground limits the growth of grass, while the separation from the ground, even though minimal, prevents corrosive phenomena that damage it if it is made of metal.

According to a variant, on the lower part the base has through transverse apertures, prepared during the production step, which allow the water to drain.

In one embodiment, the upright integrally includes connection means by means of which it is possible to associate at the upper part thereof an extension upright when it is necessary to use a barrier with a greater height.

In a possible configuration, the road barrier according to the invention comprises, above the first longitudinal element, at least a second longitudinal element, also consisting of a tubular profile, passed through by the upright. In another configuration the barrier has soundproofing and/or anti-dazzle panels arranged between the first and second longitudinal element, or above them.

In a preferential solution, at least the first longitudinal element has a vertically extended section, for example ovoid or octagonal, with the lateral segments distanced with respect to the upright which passes through it; thus, in the event of impact, the barrier ensures both the necessary elasticity and deformability and also high resistance to breakthrough. According to a variant, to further increase resistance to breakthrough, at least the first longitudinal element is passed through longitudinally by a strip, or cable, of suitable high-resistance material, constrained to the uprights, or part of them, or resting on them and constrained only to the ends.

BRIEF DESCRIPTION OF THE DRAWINGS

These and other characteristics of the present invention will become apparent from the following description of a preferential form of embodiment, given as a non-restrictive example, with reference to the attached drawings wherein.

DETAILED DESCRIPTION OF THE DRAWINGS

Figure 1:
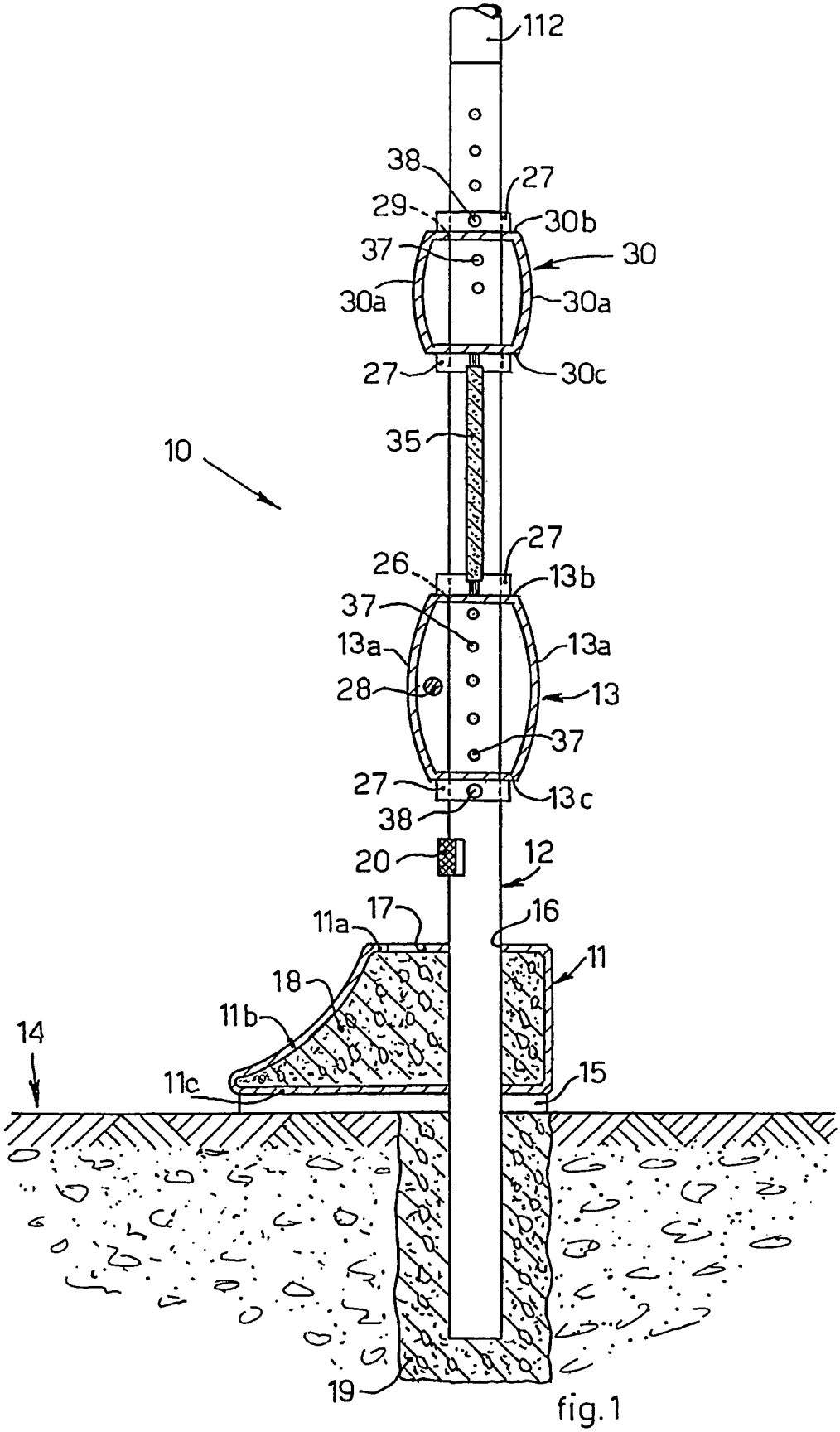
FIG. 1 shows a transverse section of a road barrier according to the invention.

In the attached figures, the number 10 denotes in its entirety the road barrier according to the invention, which has a modular configuration wherein each module comprises at least a base 11, an upright or vertical component 12 and a first longitudinal element or horizontal component 13. In the embodiment shown here, the barrier 10 also has a second longitudinal element 30 above the first longitudinal element 13.

The base 11 consists of a tubular metal profile, with a height of about 250 mm and a substantially rectangular trapezium section, with the smaller base 11*a* facing upwards and the inclined side 11*b* facing towards the roadway 14.

According to a variant, the base 11 consists of an article made of high resistance material, for example armed or reinforced concrete.

In the preferential embodiment shown here, the inclined side 11*b* has a curvilinear development and defines a slight concavity facing towards the roadway 14.

The lower part of the base 11 rests on spacer elements 15 made of synthetic material, such as plastic, Teflon, nylon or suchlike, suitable to resist bad weather and damp. The spacer elements 15, located on the ground or the road surface, are about 30 mm high and equal in width to that of the larger base 11*c* of the base 11; they are arranged at a distance from one another, so as to keep the base 11 raised from the ground in order to prevent, or at least limit, corrosion if it is made of metal, at the same time allowing the water to drain from the roadway 14 towards the outside.

According to a variant, on its lower part the base 11 has through transverse apertures with a substantially constant interaxis, which allow the water to drain.

In an off-center position towards the outside of the carriageway 36, the base 11 has vertical through holes 16 able to accommodate the uprights 12, while on the smaller base 11*a* there is at least a hole 17 by means of which the base 11 is filled inside with mortar of cement 18, concrete or other material, so as to increase the mass and rigidity thereof. In some applications, when a less rigid structure is necessary, the base 11 can be kept empty.

The base 11 advantageously has, on the lower side, small through holes that allow the drainage of the condensation and water that infiltrates inside.

Each upright 12 consists of a tubular metal profile, advantageously with a round section, with a diameter of between 45 mm and 140 mm and a height that can vary according to the application. The upright 12 is inserted into the mating through hole 16 of the basement 11 and is fixed, with its lower end, into the ground. In this case, the upright 12 is also clamped with a cast of concrete 19 to ensure a better anchorage to the ground.

The base 11 can thus be raised, sliding along the upright 12, to adapt to the variations in height of the roadway 14.

In the segment located above the base 11, each upright 12 is provided with a reflector element 20, while at its upper end it is suitable for coupling with an extension upright 112.

Figure 3:
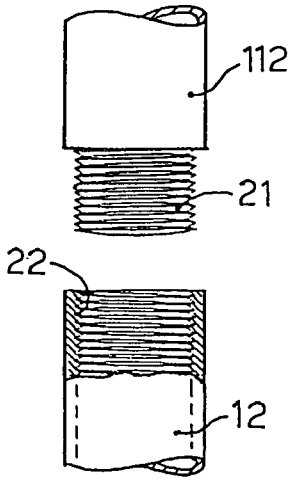
FIG. 3 shows an example of a connection between vertical components of the barrier according to the invention.
Figure 4:
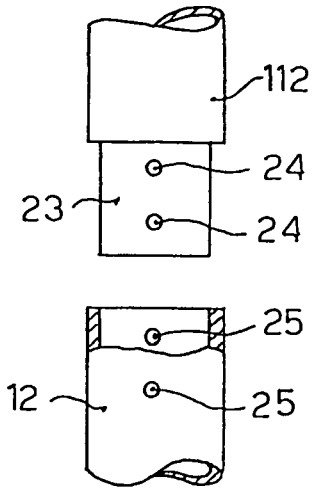
FIG. 4 shows a variant of FIG. 3.

In a first embodiment (FIG. 3), the predisposition for coupling consists of an inner threading 22 on which a threaded sleeve 21 can be screwed, with a reduced section and arranged at the lower end of the extension upright 112. In the variant shown in FIG. 4, the upright 12 has holes 25 able to be aligned with mating holes 24 made in a sleeve 23 with a reduced section present at the lower end of the extension upright 112.

According to a variant, the sleeves 21 and 23 consist of autonomous elements able to be screwed or inserted half inside the upright 12 and half inside the extension upright 112. In this solution, the two uprights 12, 112 are clamped together by means of pins or screws inserted through with respect to the relative holes 25, 24.

The height of the barrier 10 can thus be varied according to its application, connecting one or more extension uprights 112 above the uprights 12 without needing to remove the latter. Moreover, this connection is achieved keeping the outer size of the uprights 12, 112 uniform, so as to facilitate the positioning and clamping of the other components of the barrier 10 mounted thereon, without modifying the aesthetic appearance of the barrier 10.

The uprights 12, 112 are also provided, on at least a substantial part of their height, with through transverse holes 37 made with a constant interaxis and suitable to accommodate attachment pins 38 of the longitudinal elements 13, 30. The transverse hole 37 nearest the ground also has a drainage function for the condensation and water that has infiltrated. The lowest hole 37 can also be used as a reference when the uprights 12 are fixed into the ground, in order to insert all the uprights 12 of the barrier 10 to the same depth.

The first longitudinal element 13 consists of a tubular metal profile with a substantially ovoid section, or similar, so as to present two lateral segments 13*a* with a convexity facing outwards; the upper 13*b* and lower 13*c* segments are advantageously flat and in correspondence with them there are through holes 26 inside which the uprights 12 are inserted.

According to a variant not shown here, the tubular profile of the first longitudinal element 13 has an octagonal section with two extended lateral segments.

The second longitudinal element 30 is located at a desired distance from the first longitudinal element 13 and consists of a tubular profile with a conformation equivalent to that of the first longitudinal element 13, but smaller in height. The second longitudinal element 30 therefore also has the convex lateral segments 30*a* and the upper 30*b* and lower 30*c* segments flat, on which through holes 29 are made for the uprights 12 to be inserted.

According to a variant, the second longitudinal element has a circular section. Advantageously the longitudinal elements 13 and 30 also have relative drainage holes on the bottom part to drain the condensation and infiltrated water.

In correspondence with the edges of the through holes 26, 29 there are collars 27 provided with insertion seatings for the attachment pins 38.

In a first embodiment, the collars are made integrally on the longitudinal elements 13, 30, for example by drawing. According to a variant, the collars 27 are welded to the longitudinal elements 13, 30.

The uprights 12 are therefore through both with respect to the base 11 and also with respect to the longitudinal elements 13 and 30, and the latter are clamped thereon in removable fashion by means of the pins 38 located through in the insertion seatings of the collars 27 and the desired holes 37 made on the uprights 12.

In another variant, the collars 27 are autonomous elements attached to the uprights 12 by means of the clamping pins 38 in order to support the longitudinal elements 13 and 30 from below and prevent them from moving in a vertical direction.

In this way, the longitudinal elements 13 and 30 can be clamped on the uprights 12 at a different height according to the specific requirements; moreover, their height with respect to the roadway 14 can be modified as desired over time, for example due to the raising of the roadway 14 after asphalting, simply by releasing them and making them slide along the uprights 12 and then clamping them again at the desired height.

In case of necessity, other longitudinal elements 13 or 30 can be inserted, in addition to those already there.

Figure 5A:
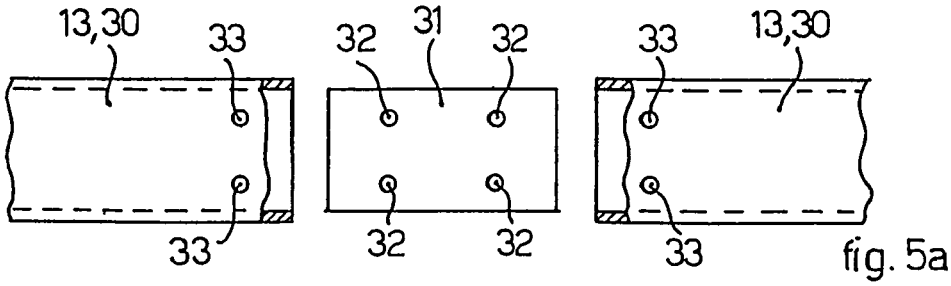
FIGS. 5*a*–5*c* show an example of a connection between horizontal components of the barrier according to the invention.
Figure 5B:
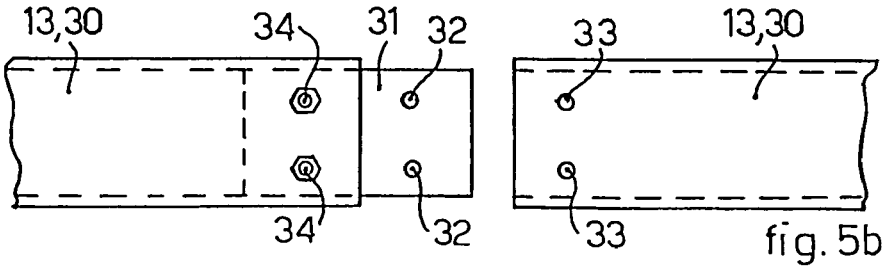
Figure 5C:
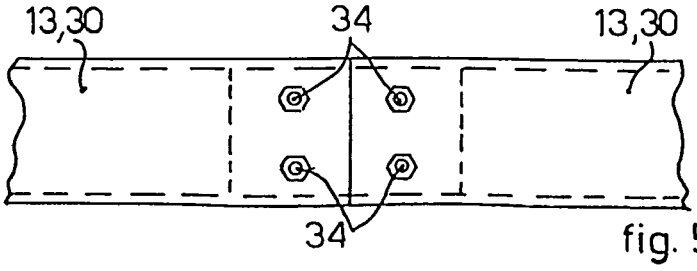

The joint between two contiguous first longitudinal elements 13, or between two contiguous second longitudinal elements 30 (FIGS. 5*a*–5*c*), is made by means of a sleeve 31 with a mating section inserted half in one and half in the other of the two longitudinal elements 13 or 30 to be joined.

The sleeve 31 has through holes 32 able to be aligned with mating through holes 33 made on the longitudinal elements 13, 30 when the sleeve 31 is inserted inside them. The parts are clamped together by means of pins or screws 34.

Similarly, the bases 11 can be joined together by means of respective sleeves or by means of connection plates.

The joints are made with the section of the components concerned kept constant, with advantages in terms of aesthetics and functionality.

Figure 2:
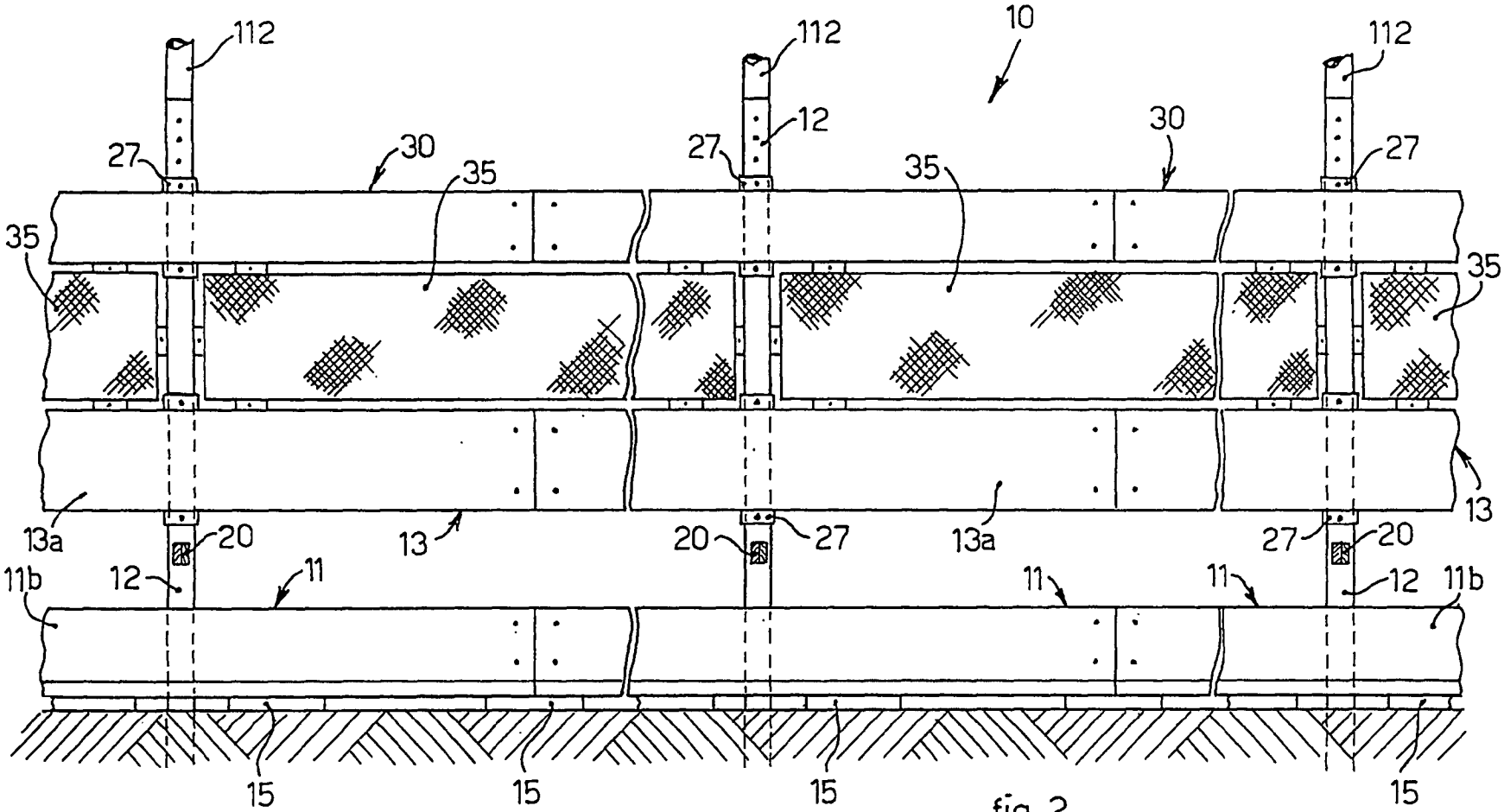
FIG. 2 shows a front view of the barrier in FIG. 1.

In the embodiment shown in FIGS. 1 and 2, in the space between the longitudinal elements 13 and 30 panels 35 of the soundproofing and/or anti-dazzle type are attached.

Thanks to its completely modular tubular structure, the barrier 10 can assume a plurality of configurations wherein it always guarantees high resistance to breakthrough and at the same time the necessary elasticity and capacity to absorb shocks.

Figure 6:
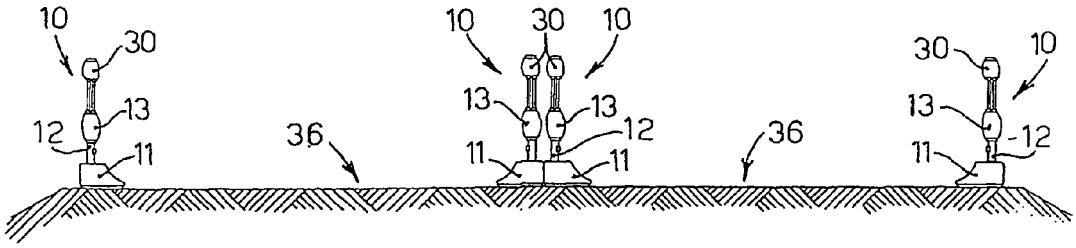
FIGS. 6 and 7 show two applications of the barrier according to the invention.

As shown in FIG. 6, the barrier 10 can be used in a single configuration as lateral protection and containment, or in a double configuration as a traffic-divider located between two carriageways 36.

Figure 7:
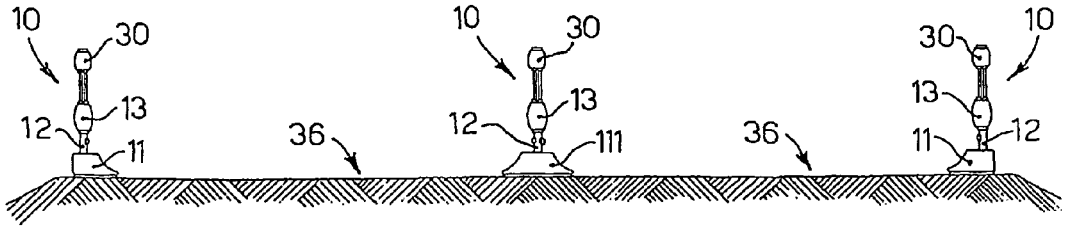

When the roadway is too narrow to use a double barrier 10 in order to separate the two carriageways 36, it is possible to use a single barrier 10 provided with a base 111 conformed as an isosceles trapezium with respect to which the uprights 12 are attached in a central position (FIG. 7).

In all cases, due to the fact that the base 11 has the inclined side 11*b* protruding towards the roadway 14 with respect to the upright 12 and the longitudinal elements 13, 30, if a vehicle comes too close to the barrier 10, its tires first come into contact with the base 11, and mount the inclined side 11*b*. In this way, the weight of the vehicle contributes to prevent displacements of the barrier 10, while the conformation of the inclined side 11*b* diverts the vehicle towards the carriageway 36, at the same time providing the driver with an immediate warning of the danger.

Moreover, in the event of superficial collision, the more retracted position of the uprights 12 and of the longitudinal elements 13 and 30 prevents the impact against them by the vehicle, and prevents damage to the reflectors 20, limiting the frequency of maintenance operations and repairs.

The closed form and surface continuity of the components of the barrier 10 make cleaning operations easier and limit the growth of grass nearby.

In the event of a violent impact, the tubular conformation of the longitudinal elements 13 and 30, with the lateral segments 13*a* and 30*a* convex and separated from the uprights 12, confers the necessary elasticity to the barrier 10, allowing a better absorption of the shock compared with rigid barriers, and a certain deformability which prevents the vehicle from rebounding towards the center of the carriageway 36.

The closed section of the longitudinal elements 13, 30 also offers a greater resistance to breakthrough and limits damage to vehicles and persons caused by using open and cutting profiles in conventional barriers.

According to a variant, to further increase this resistance, inside the first longitudinal elements 13 a reinforcement element is inserted, such as a steel cable 28, a strip of synthetic fiber or other suitable material, constrained to at least part of the uprights 12 or resting thereon and constrained only to the ends.

The second longitudinal elements 30, or possible other longitudinal elements, can also have similar reinforcement elements inserted through.

It is clear, however, that modifications and/or additions of parts may be made to the road barrier 10 as described heretofore without departing from the field and scope of the present invention.

For example the section of the uprights 12, 112 and of the longitudinal elements 13, 30 can be different from the one shown and described here, such as a polygonal section or similar.

It is also clear that, although the present invention has been described with reference to specific examples, the person of skill in the art shall certainly be able to achieve many other equivalent forms of road barrier, all of which shall come within the field and scope of the present invention.

The invention claimed is:

1. Road barrier with a function as a traffic-divider or of lateral containment and protection, said barrier comprising a plurality of modules each of which has at least an upright, or vertical component, fixed in the ground, and at least a first longitudinal element, or horizontal component, associated therewith, wherein said upright and said first longitudinal element consist of tubular profiles, said upright being arranged through inside said first longitudinal element, so that said first longitudinal element can be moved vertically and selectively clamped at a desired height along said upright.

2. Road barrier as in claim 1, comprising a base provided with an inclined side protruding towards the roadway, said upright being arranged through inside said base.

3. Road barrier as in claim 2, wherein said side has a curvilinear conformation and defines a concavity facing towards the roadway.

4. Road barrier as in claim 2, wherein said base comprises a tubular profile with a substantially trapezoid section.

5. Road barrier as in claim 4, wherein said base has at least a hole for passing therethrough a material suitable to increase the rigidity of the base thereof, such as mortar of cement (18), or concrete.

6. Road barrier as in, claim 1, wherein said base consists of a full-section article, made of concrete or armed cement.

7. Road barrier as in claim 2, wherein said base is mounted on spacer elements able to keep the base slightly raised with respect to the ground and arranged distanced from each other to allow water to drain from the roadway.

8. Road barrier as in claim 7, wherein said spacer elements comprise synthetic material selected from the group consisting of plastic, nylon, and Teflon.

9. Road barrier as in claim 6, wherein at least on a bottom part of said base, said base has through transverse apertures able to allow water to drain from the roadway.

10. Road barrier as in claim 2, wherein said base is able to slide vertically along said upright to be arranged at different heights according to the variations in height of the roadway.

11. Road barrier as in claim 2, wherein said upright is arranged off-center towards the outside of the carriageway with respect to said base.

12. Road barrier as in claim 1, wherein said upright integrally includes coupling means for an extension upright to be associated at a top part of said upright.

13. Road barrier as in claim 12, wherein said coupling means comprise at least an inner threading on which a threaded sleeve, associated with said extension upright, is able to be screwed.

14. Road barrier as in claim 12, wherein said coupling means comprise through transverse holes able to cooperate with mating holes made on a sleeve associated with said extension upright, said sleeve being able to be inserted and attached, by pins or screw, to said upright.

15. Road barrier as in claim 1, comprising at least a second longitudinal element above said first longitudinal element said second longitudinal element, comprising a tubular profile, passed through by said upright along which said second longitudinal element can be moved and selectively clamped.

16. Road barrier as in claim 1, wherein said longitudinal elements cooperate with collar means provided with insertion apertures for pin means which allow said longitudinal elements to be reversibly clamped on said upright.

17. Road barrier as in claim 16, wherein said insertion apertures are able to be aligned with mating holes made at variable heights on said upright for the through insertion of said pin means.

18. Road barrier as in claim 16 wherein said collar means are integrally made on said longitudinal elements.

19. Road barrier as in claim 16, wherein said collar means are attached on said longitudinal elements.

20. Road barrier as in claim 16, wherein said collar means are autonomous elements able to be attached on said upright to support said longitudinal elements from below and to prevent their vertical displacement.

21. Road barrier as in claim 1, comprising soundproofing and/or anti-dazzle panels.

22. Road barrier as in claim 15, comprising soundproofing and/or anti-dazzle panels, wherein said panels are arranged between said first longitudinal element and said second longitudinal element.

23. Road barrier as in claim 15, comprising soundproofing and/or anti-dazzle panels, wherein said panels are arranged above said second longitudinal element.

24. Road barrier as in claim 1, wherein said first longitudinal element and/or said second longitudinal element are passed through longitudinally by a reinforcement element comprisisng high resistance material selected from the group consisting of a metal cable or a strip of synthetic fiber.

25. Road barrier as in claim 1, wherein at least said first longitudinal element has an ovoid section, or similar, and longer lateral segments having a convexity facing towards the outside, so as to be distanced from said upright.

26. Road barrier as in claim 1, wherein at least said first longitudinal element has a polygonal section vertically extended.

27. Road barrier as in claim 1, wherein said first longitudinal element has a plane upper segment and lower segment in correspondence with which said first longitudinal element is passed through by said upright.

28. Road barrier as in claim 1, comprising sleeve means or plate means able to be inserted in a retracted position inside contiguous bases or longitudinal elements suitable to join them together by means of pin or screw means.

29. Road barrier as in claim 1, wherein said tubular profiles are made of metal.

30. Road barrier as in claim 1, wherein at a lower part, said tubular profiles have through holes to drain condensation and water which has infiltrated inside said tubular profiles.

* * * * *